US009387999B2

(12) United States Patent
Murakami et al.

(10) Patent No.: US 9,387,999 B2
(45) Date of Patent: Jul. 12, 2016

(54) SHEET FEEDING DEVICE AND IMAGE FORMING APPARATUS

(71) Applicant: CANON KABUSHIKI KAISHA, Tokyo (JP)

(72) Inventors: Atsushi Murakami, Kawasaki (JP); Daisuke Aoki, Yokohama (JP); Yu Shuhama, Yokohama (JP); Naoki Inoue, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/558,623

(22) Filed: Dec. 2, 2014

(65) Prior Publication Data

US 2015/0151935 A1 Jun. 4, 2015

(30) Foreign Application Priority Data

Dec. 4, 2013 (JP) ..... 2013-251321

(51) Int. Cl.

| | |
|---|---|
| ***B65H 7/02*** | (2006.01) |
| ***B65H 1/14*** | (2006.01) |
| ***B65H 1/18*** | (2006.01) |
| ***B65H 3/06*** | (2006.01) |
| ***B65H 5/26*** | (2006.01) |
| ***B65H 1/26*** | (2006.01) |
| ***B65H 5/06*** | (2006.01) |
| ***B65H 7/04*** | (2006.01) |

(52) U.S. Cl.

CPC .. *B65H 1/14* (2013.01); *B65H 1/18* (2013.01); *B65H 1/266* (2013.01); *B65H 3/0669* (2013.01); *B65H 3/0684* (2013.01); *B65H 5/062* (2013.01); *B65H 5/26* (2013.01); *B65H 7/04* (2013.01); *B65H 2404/611* (2013.01); *B65H 2407/21* (2013.01); *B65H 2511/20* (2013.01); *B65H 2511/22* (2013.01); *B65H 2511/518* (2013.01); *B65H 2513/40* (2013.01)

(58) Field of Classification Search

CPC ..... B65H 1/04; B65H 7/02; B65H 7/04; B65H 7/06; B65H 7/14

USPC ..... 271/110, 111, 114, 117, 118, 265.01, 271/258.01, 259, 265.02, 258.04, 265.03, 271/262, 263, 127, 30.1, 155, 31, 128, 152

See application file for complete search history.

(56) References Cited

U.S. PATENT DOCUMENTS

| | | | | |
|---|---|---|---|---|
| 4,871,160 | A * | 10/1989 | Yoshino | 271/9.02 |
| 7,823,876 | B2 * | 11/2010 | Okumura et al. | 271/155 |
| 2009/0079126 | A1 * | 3/2009 | Hattori | 271/117 |

FOREIGN PATENT DOCUMENTS

| | | | |
|---|---|---|---|
| JP | 59-78021 | * | 5/1984 |
| JP | 3-26637 | * | 2/1991 |
| JP | 6-56305 | * | 3/1994 |
| JP | 2009-214966 | A | 9/2009 |
| JP | 2009-215041 | A | 9/2009 |

OTHER PUBLICATIONS

Machine translation of JP6-56305.*

* cited by examiner

*Primary Examiner* — Thomas Morrison

(74) *Attorney, Agent, or Firm* — Canon USA, Inc. IP Division

(57) ABSTRACT

If a second detecting unit has detected an upper surface of a stack of sheets without a first detecting unit detecting the upper surface of the stack of sheets when a pickup roller is moved from a moved position to a pickup position, a control unit lifts a stacking plate by a first predetermined amount. If the pickup roller is moved from the moved position to the pickup position without the first detecting unit and the second detecting unit detecting the upper surface of the stack of sheets, the control unit lifts the stacking plate by a second predetermined amount greater than the first predetermined amount.

23 Claims, 15 Drawing Sheets

SHEET FEEDING DEVICE AND IMAGE FORMING APPARATUS

BACKGROUND

1. Field

Aspects of the present invention generally relate to a sheet feeding device and an image forming apparatus.

2. Description of the Related Art

Image forming apparatuses include sheet feeding devices that feed sheets. A known sheet feeding device includes a lifter mechanism that maintains the level of the upper surface of a stack of sheets on a stacking member to be at substantially constant, and a pickup roller that picks up one of the sheets that is at the substantially constant level.

Specifically, the sheet feeding device includes a sensor that detects whether or not the upper surface of the stack of sheets on the stacking member is at a feedable position (the substantially constant level). On the basis of a signal from the sensor, the stacking member is moved up and down. Thus, the level of the upper surface of the stack of sheets on the stacking member can be maintained to be substantially constant, and a stable sheet feeding operation can be performed.

However, if the stack of sheets is curled, the upper surface of the stack of sheets has level variations. In such a case, the sensor may incorrectly detect the level of the upper surface of the stack of sheets. Hence, a sheet feeding device is disclosed by Japanese Patent Laid-Open No. 2009-214966 in which, if it has been detected a plurality of times that the upper surface of the stack of sheets is not at the feedable position after the start of the sheet feeding operation, a control operation of lifting the stacking member is performed. Another sheet feeding device is disclosed by Japanese Patent Laid-Open No. 2009-215041 that includes a curl detecting mechanism and performs a control operation of moving the stacking member up and down in accordance with the size of the curl in the stack of sheets.

In yet another sheet feeding device, a feeding path extending from a manual feed tray (a second pickup member) and a feeding path extending from a cassette (a first pickup member) merge with each other at a position below a pickup roller that picks up one of the sheets in the cassette. In such a configuration, to feed a sheet from the manual feed tray (the second pickup member), the pickup roller that picks up one of the sheets in the cassette needs to be moved upward so that a conveyance path is provided.

The device disclosed by Japanese Patent Laid-Open No. 2009-214966 cannot be applied to the sheet feeding device in which the feeding path extending from the cassette (the first pickup member) and the feeding path extending from the manual feed tray (the second pickup member) merge with each other as described above.

This is because the device disclosed by Japanese Patent Laid-Open No. 2009-214966 is to detect the level of the upper surface of the stack of sheets in conjunction with the movement of the pickup roller, whereas the level of the upper surface of the stack of sheets cannot be detected in conjunction with the movement of the pickup roller in the sheet feeding device in which the two feeding paths merge with each other as described above.

In the device disclosed by Japanese Patent Laid-Open No. 2009-215041, a mechanism of lowering the stacking member at the detection of any curls is necessary, increasing the complexity and the cost of the device.

SUMMARY

Aspects of the present invention generally provide a sheet feeding device and an image forming apparatus each including a configuration in which a stacking member is lifted with a pickup roller being moved away, each of sheets can be fed stably even if the sheets are curled, and the increase in the cost of the device or the apparatus is suppressed.

According to an aspect of the present invention, a sheet feeding device includes a stacking member on which a stack of sheets is placed, a lifting unit configured to lift the stacking member, a pickup member that is movable between a pickup position where the pickup member picks up one of the sheets on the stacking member and a moved position where the pickup member is at an upper position higher than the pickup position, a pickup-member-moving unit configured to move the pickup member between the pickup position and the moved position, a first detecting unit configured to detect an upper surface of the stack of sheets on the stacking member in conjunction with the pickup member moving between the pickup position and the moved position, a second detecting unit configured to detect the upper surface of the stack of sheets on the stacking member, wherein the second detecting unit detects at a position below a position of detection by the first detecting unit in a direction in which the stacking member is lifted, and a control unit configured to control the lifting unit based on a result of detection by the first detecting unit and a result of detection by the second detecting unit. If the second detecting unit has detected the upper surface of the stack of sheets without the first detecting unit detecting the upper surface of the stack of sheets when the pickup-member-moving unit has moved the pickup member from the moved position to the pickup position, the control unit controls the lifting unit to lift the stacking member by a first predetermined amount. If the pickup-member-moving unit has moved the pickup member from the moved position to the pickup position without the first detecting unit and the second detecting unit detecting the upper surface of the stack of sheets, the control unit controls the lifting unit to lift the stacking member by a second predetermined amount that is greater than the first predetermined amount.

Further features of the present disclosure will become apparent from the following description of exemplary embodiments with reference to the attached drawings.

DESCRIPTION OF THE EMBODIMENTS

First Embodiment

A first embodiment will now be described with reference to the attached drawings. Herein, a laser beam printer is taken as an exemplary image forming apparatus. In the exemplary image forming apparatus, toner images in different colors that have been formed on respective photosensitive drums are sequentially transferred to a belt, and the toner images on the belt are collectively transferred to a recording material.

Figure 1:
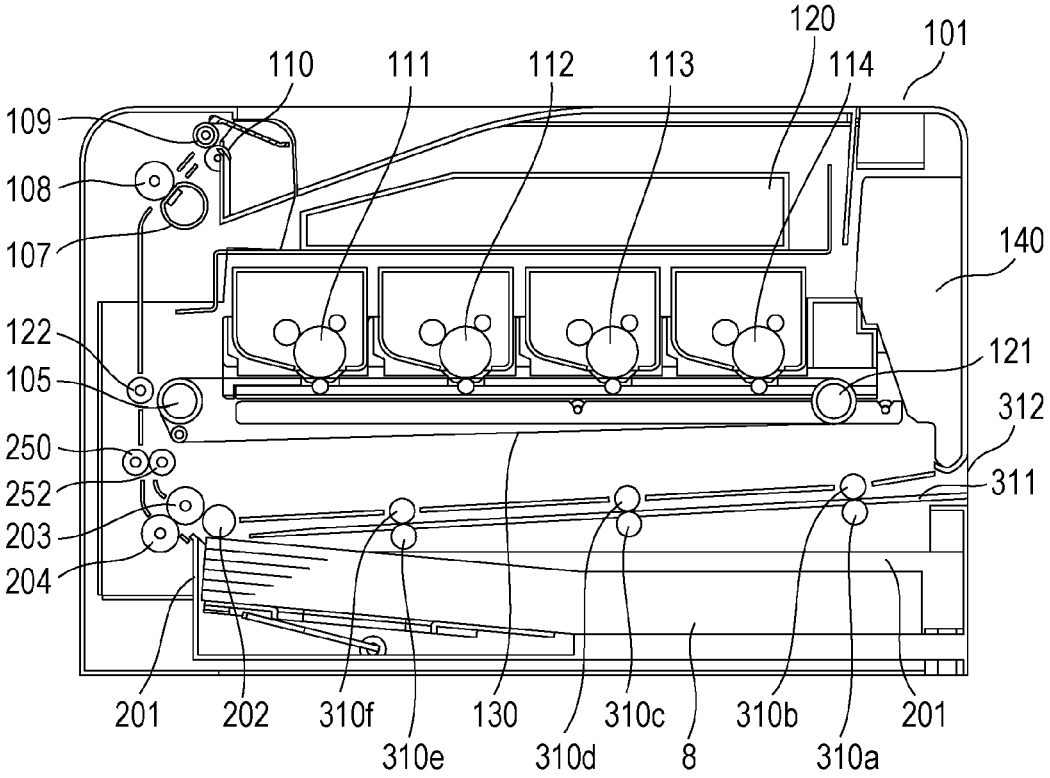
FIG. 1 is a schematic sectional view of an image forming apparatus.

An outline configuration of the image forming apparatus will first be described with reference to FIG. 1. FIG. 1 is a schematic sectional view of an image forming apparatus 101. Sheets 8 contained in a sheet cassette (sheet containing unit) 201 that is insertable into and drawable from the image forming apparatus 101 are picked up one by one by a pickup roller (pickup member) 202 that rotates in the clockwise direction in FIG. 1. The sheet 8 thus picked up is conveyed to a nip portion formed between a conveying roller 250 and a counterpart conveying roller 252 and further to a nip portion (hereinafter also referred to as transfer nip) formed between an in-belt roller 105 and a transfer roller 122. That is, the conveying roller 250 and the counterpart conveying roller 252 in combination function as a pair of registration rollers that convey the sheet 8 to the transfer nip in accordance with the timing of image transfer.

Photosensitive drums 111, 112, 113, and 114 as image carrying members included in an image forming portion each rotate in the counterclockwise direction in FIG. 1. In the image forming portion, a laser scanner 120 applies laser beams to the outer circumferential surfaces of the respective photosensitive drums 111, 112, 113, and 114, whereby electrostatic latent images are formed sequentially on the respective photosensitive drums 111, 112, 113, and 114. The electrostatic latent images are developed into toner images by respective developing rollers.

The toner images thus formed on the photosensitive drums 111, 112, 113, and 114 are transferred to an intermediate transfer belt 130. If a color image is to be formed, the electrostatic latent images are developed into toner images in yellow, magenta, cyan, and black on the photosensitive drums 111, 112, 113, and 114, respectively, and are sequentially transferred to the intermediate transfer belt 130. The toner images thus transferred to the intermediate transfer belt 130 are collectively transferred to the sheet 8 that has been conveyed to the nip portion between the in-belt roller 105 and the transfer roller 122. A tension is applied to the intermediate transfer belt 130 by a tension roller 121.

The sheet 8 to which the toner images have been transferred is conveyed to a nip portion formed between a fixing film 107 and a pressure roller 108, where the toner images are heated and pressed, thereby being fixed to the sheet 8. The sheet 8 to which the toner images have been fixed is discharged to a discharge tray by a discharge roller 109 and a discharge runner 110. The discharge tray is provided on the outside of the image forming apparatus 101.

Figure 10:
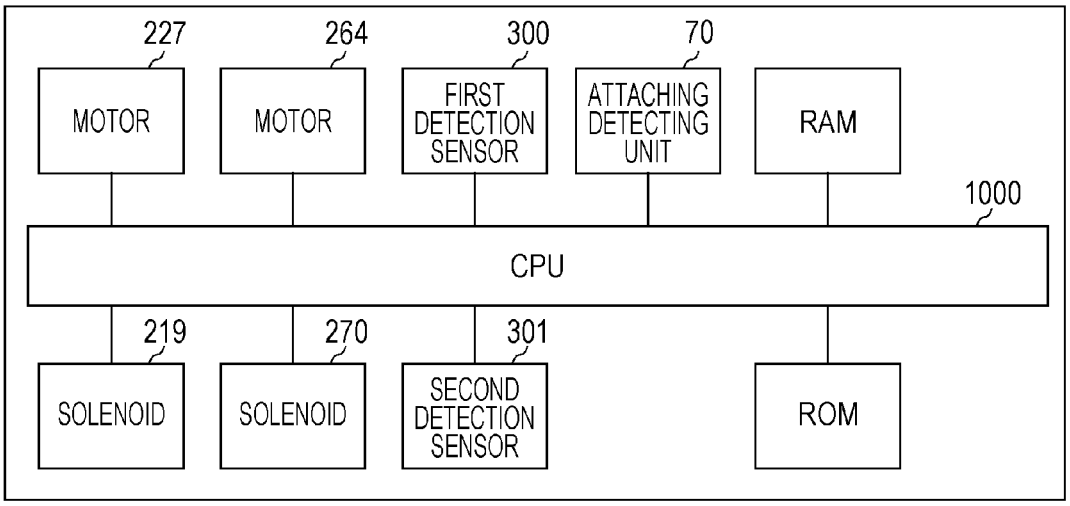
FIG. 10 is a block diagram of the sheet feeding device according to the first embodiment.

FIG. 10 is a block diagram of the sheet feeding device according to the first embodiment. As illustrated in FIG. 10, a central processing unit (CPU) 1000 is connected to a motor (a first drive source) 227 as a drive source for a stacking plate 206, a motor (a second drive source) 264 as a drive source for the pickup roller 202, a solenoid (a first solenoid) 219 for the stacking plate 206, a solenoid (a second solenoid) 270 for the pickup roller 202, a first detection sensor 300, a second detection sensor 301, and an attaching detecting unit 70. The CPU 1000 is also connected to a read-only memory (ROM) and a random access memory (RAM). The CPU 1000 executes programs stored in the ROM by using the RAM as a working memory. In the first embodiment, the CPU 1000, the ROM, and the RAM constitute a control unit.

Configuration of Sheet Feeding Device

Figure 2A:
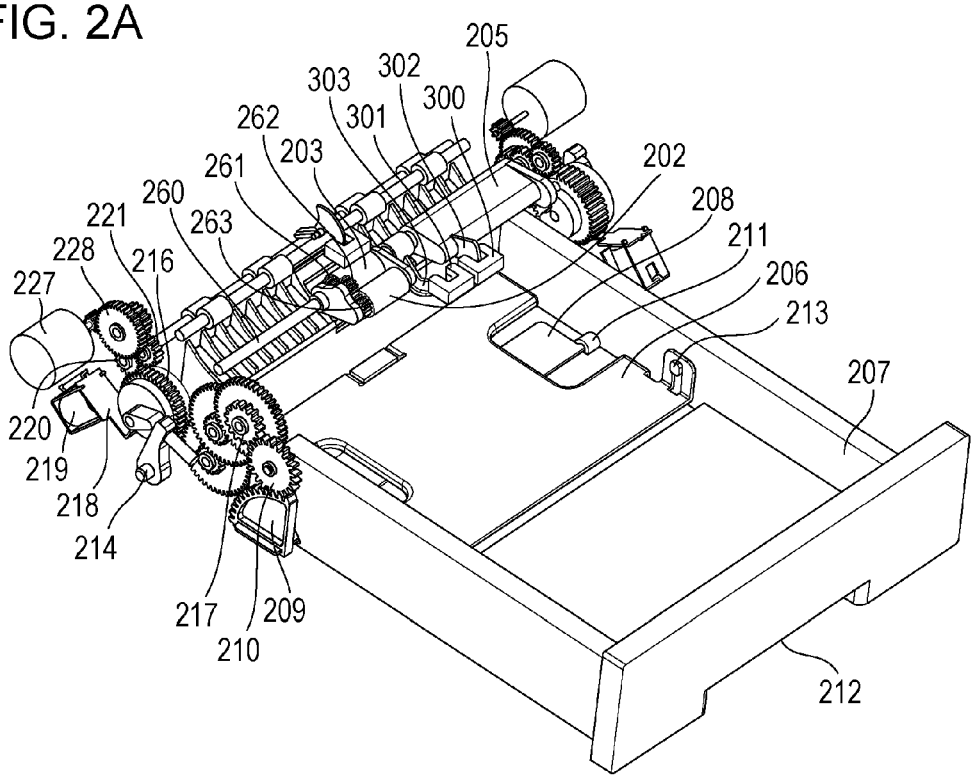
FIGS. 2A and 2B are perspective views of a sheet feeding device according to a first embodiment.
Figure 2B:
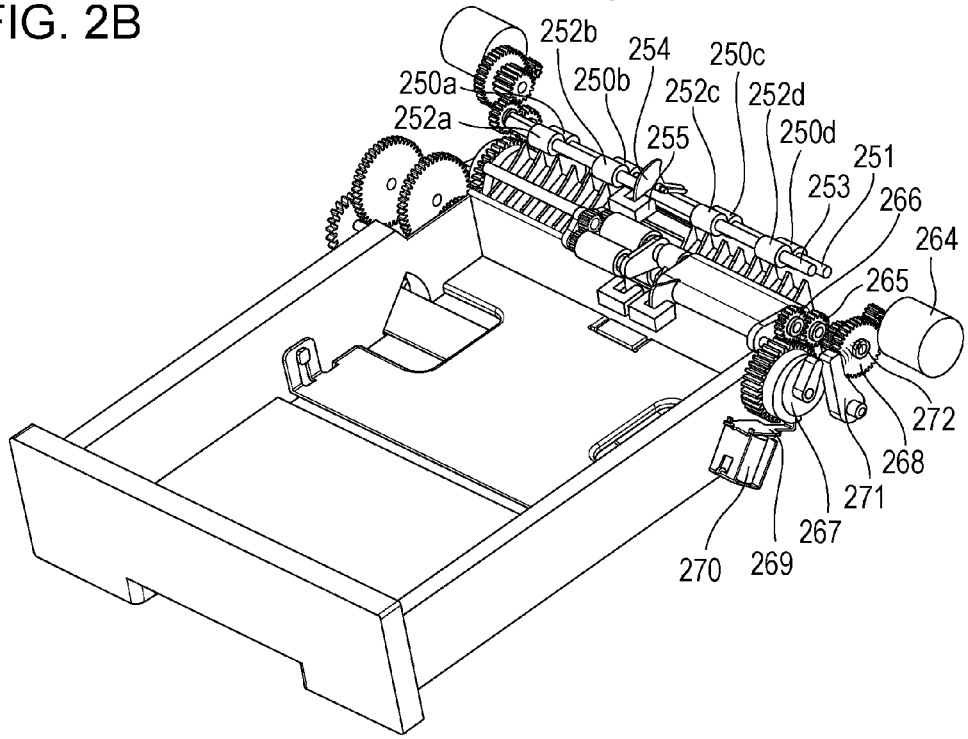

FIGS. 2A and 2B are perspective views of a sheet feeding device according to the first embodiment that are seen from a lifter driving side and from a feeder driving side, respectively.

Mechanism of Sheet Cassette

The sheet feeding device according to the first embodiment employs a retard roller method in which feeding from the sheet cassette 201 is performed by using a backward rotating roller that rotates in a direction opposite to the direction of sheet conveyance. As illustrated in FIGS. 2A and 2B, the pickup roller 202 is supported by a supporting member 205 that is swingable up and down about the center of a feed roller 203.

The pickup roller 202 picks up a sheet 8 while being in contact with the upper surface of the stack of sheets 8 on the stacking plate (stacking member) 206 provided in the sheet cassette 201. When feeding is not performed, the pickup roller 202 is at an upper position. That is, the pickup roller 202 is movable between a pickup position where the pickup roller 202 picks up one of the sheets 8 on the stacking plate 206 and a moved position where the pickup roller 202 is at a position higher than the pickup position.

To feed a sheet 8, a voltage is applied to the solenoid 270, and a rotation preventing member 269 that prevents the rotation of a partially toothless feed gear 267 is disabled, whereby the supporting member 205 and the pickup roller 202 are rotated downward (lowered) about the center of the feed roller 203. That is, the solenoid 270 is switched on the basis of whether or not to transmit a driving force generated by the motor 264 to the pickup roller 202 so as to move the pickup roller 202. If the driving force is transmitted to the downstream side of the partially toothless feed gear 267, the feed roller 203 rotates. That is, the motor 264 and the solenoid 270 constitute a pickup-member-moving unit that moves the pickup roller 202 up and down.

When the supporting member 205 is lowered, the pickup roller 202 comes into contact with the upper surface of the stack of sheets 8 and picks up one of the sheets 8. The sheet 8 thus picked up is fed into a nip portion formed between the feed roller 203 and a retard roller 204. The pickup roller 202 is kept at the upper position until the next feeding operation is performed. That is, the pickup roller 202 moves between the moved position and the pickup position for every feeding of a sheet 8.

A drive shaft for the retard roller 204 is provided with a torque limiter (not illustrated). The pickup roller 202, the feed roller 203, and the retard roller 204 rotate by receiving the driving force transmitted from the motor 264.

The sheet feeding device includes idler gears 261, 262, and 266, a pickup roller gear 263, a feed-roller-driving gear 265, a stepped gear 268, and a lever pressing spring 272 that presses a lever 271.

An operation of separating one sheet 8 from the other sheets 8 in the sheet feeding device employing the retard roller method will now be described.

As described above, the pickup roller 202 that is under rotation picks up one of the sheets 8 that are stacked on the stacking plate 206. If only a single sheet 8 is picked up, a large running torque is applied to the retard roller 204, which forms the nip portion in combination with the feed roller 203, with the sheet 8 interposed therebetween, whereby the torque limiter is disabled. Hence, a driving force for rotating the retard roller 204 in the backward direction is not transmitted to the retard roller 204, and the retard roller 204 rotates by following the movement of the sheet 8 that is conveyed.

If two or more sheets 8 are picked up at a time by the pickup roller 202, only a frictional force produced between the sheets 8 is transmitted to the retard roller 204. Hence, the torque limiter is not disabled, and the driving force for rotating the retard roller 204 in the backward direction is transmitted to the retard roller 204. Thus, the retard roller 204 rotates in the backward direction. Consequently, all the sheets 8 but the one that is in contact with the feed roller 203 are returned toward the upstream side in the direction of sheet conveyance.

As described above, according to the first embodiment, only one of the sheets 8 can be assuredly fed while being separated from the other sheets 8 by the backward rotation of the retard roller 204. The sheet 8 thus separated from the others is conveyed by conveying rollers 250*a*, 250*b*, 250*c*, and 250*d* and counterpart conveying rollers 252*a*, 252*b*, 252*c*, and 252*d*. The conveying rollers 250*a*, 250*b*, 250*c*, and 250*d* rotate about a conveying roller shaft 251. The counterpart conveying rollers 252*a*, 252*b*, 252*c*, and 252*d* rotate about a counterpart conveying roller shaft 253.

Manual Feeding Mechanism

As illustrated in FIG. 1, the image forming apparatus 101 includes a manual feeding mechanism. To perform manual feeding, the user inserts a sheet 8 into a manual feeding slot 312 provided between a cartridge door 140 and the sheet cassette 201. The sheet 8 thus inserted into the manual feeding slot 312 is conveyed in a direction toward the pickup roller 202 by manual feed conveying rollers 310*a* and 310*b*. The sheet 8 is further conveyed by a pair of conveying rollers 310*c* and 310*d* and a pair of conveying rollers 310*e* and 310*f* along a manual feed conveyance guide 311, passes a position below the pickup roller 202 that is kept at the upper position, and is further conveyed to the pair of registration rollers by the feed roller 203 and the retard roller 204. That is, in the first embodiment, the conveyance path along which the sheet 8 fed from the manual feeding slot 312 is conveyed and the conveyance path along which the sheet 8 fed from the sheet cassette 201 is conveyed merge with each other on the upstream side of the feed roller 203.

The sheet cassette 201 includes a cassette frame 207, the stacking plate 206 attached to the cassette frame 207 and being rotatable, and a lifting arm 208 that lifts the stacking plate 206. The sheet cassette 201 is inserted into a main body from the front side (the right side in FIG. 1) of the image forming apparatus 101.

To lift the stacking plate 206, the control unit applies a voltage to the solenoid 219, thereby disabling a rotation preventing member 218 that prevents the rotation of a partially toothless gear 216. Consequently, a driving force from the motor 227 is transmitted to the downstream side of the partially toothless gear 216, the lifting arm 208 rotates together with a lifting-arm-driving gear 209, and the stacking plate 206 on which the sheets 8 are stacked is rotated upward about a rotating shaft 213. That is, the solenoid 219 is switched on the basis of whether or not to transmit the driving force generated by the motor 227 to the stacking plate 206 so as to move the stacking plate 206. That is, the motor 227 and the solenoid 219 constitute a lifting unit that lifts the stacking plate 206.

The sheet feeding device includes interface gears 210 and 217, an idler gear 220, a driving gear 221 provided for the lifting unit, a stepped gear 228, a bearing 211 provided for the lifting arm 208, and a lever pressing spring that presses a lever 214.

When the sheet cassette 201 is drawn out of the main body, the stacking plate 206 is lowered. The sheet cassette 201 has a grip 212 to be gripped when the sheet cassette 201 is drawn.

Figure 4:
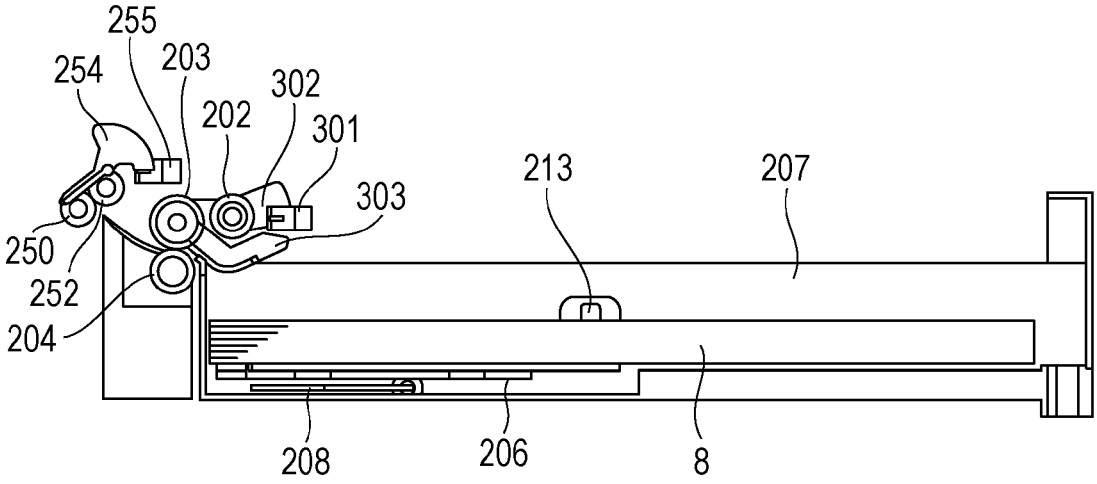
FIG. 4 illustrates the sheet feeding device according to the first embodiment.
Figure 5A:
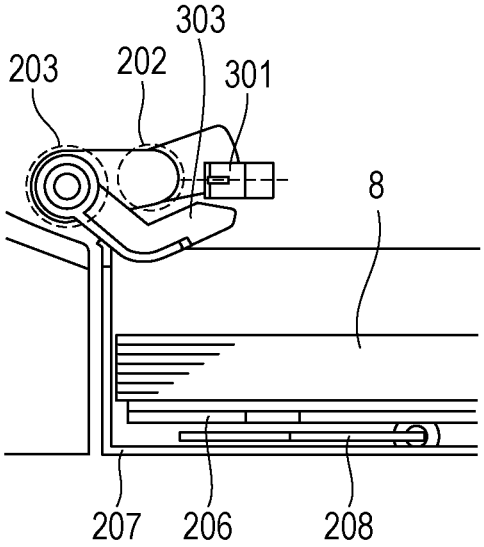
FIGS. 5A and 5B illustrate the sheet feeding device according to the first embodiment.
Figure 5B:
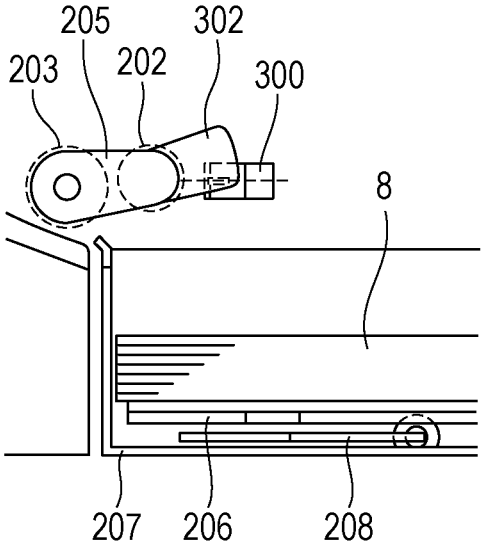

Now, a first detecting unit and a second detecting unit that detect the upper surface of the stack of sheets 8 on the stacking plate 206 will be described. FIG. 4 and FIGS. 5A and 5B are sectional views of the sheet feeding device with the sheet cassette 201 being set in the image forming apparatus (main body) 101.

The first detecting unit includes a first-sensor-detected member 302 and the first detection sensor 300. The second detecting unit includes a second-sensor-detected member 303 and the second detection sensor 301.

The first-sensor-detected member 302 is rotatably provided on the supporting member 205 and switches the signal of the first detection sensor 300, which is a photosensor, between on (a state where light is blocked) and off (a state where light is allowed to travel). Hence, the first-sensor-detected member 302 rotates together with (operates in conjunction with) the supporting member 205 that supports the pickup roller 202. In the state where the pickup roller 202 is at the upper position by the supporting member 205, the first-sensor-detected member 302 keeps the first detection sensor 300 on. If the upper surface of the stack of sheets 8 on the stacking plate 206 is below a feedable position when the pickup roller 202 is lowered by the supporting member 205, the first-sensor-detected member 302 turns the first detection sensor 300 off (the first-sensor-detected member 302 does not turn the first detection sensor 300 on). If the upper surface of the stack of sheets 8 on the stacking plate 206 is above the feedable position when the pickup roller 202 is lowered by the supporting member 205, the first detection sensor 300 is on because the first-sensor-detected member 302 is pushed up by the stack of sheets 8.

The second-sensor-detected member 303 is rotatable about a shaft 260 of the feed roller 203 and switches the signal of the second detection sensor 301, which is a photosensor, between on (a state where light is blocked) and off (a state where light is allowed to travel). The second-sensor-detected member 303 hangs down under its own weight. Therefore, when the stack of sheets 8 is lifted together with the stacking plate 206, the second-sensor-detected member 303 is pushed up and rotated upward by coming into contact with the upper surface of the stack of sheets 8. When the level of the upper surface of the stack of sheets 8 becomes higher, the second-sensor-detected member 303 switches the signal of the second detection sensor 301 from off (the state where light is allowed to travel) to on (the state where light is blocked).

As illustrated in FIGS. 5A and 5B, in the state where the pickup roller 202 is at the upper position, the first-sensor-detected member 302 keeps the first detection sensor 300 on while the second-sensor-detected member 303 hangs down under its own weight and keeps the second detection sensor 301 off (does not turn the second detection sensor 301 on).

In the first embodiment, the position of the stacking plate 206 in the height direction where the second-sensor-detected member 303 turns the second detection sensor 301 on is set to a position lower than the position in the height direction where the first-sensor-detected member 302 turns the first detection sensor 300 on.

Figure 3:
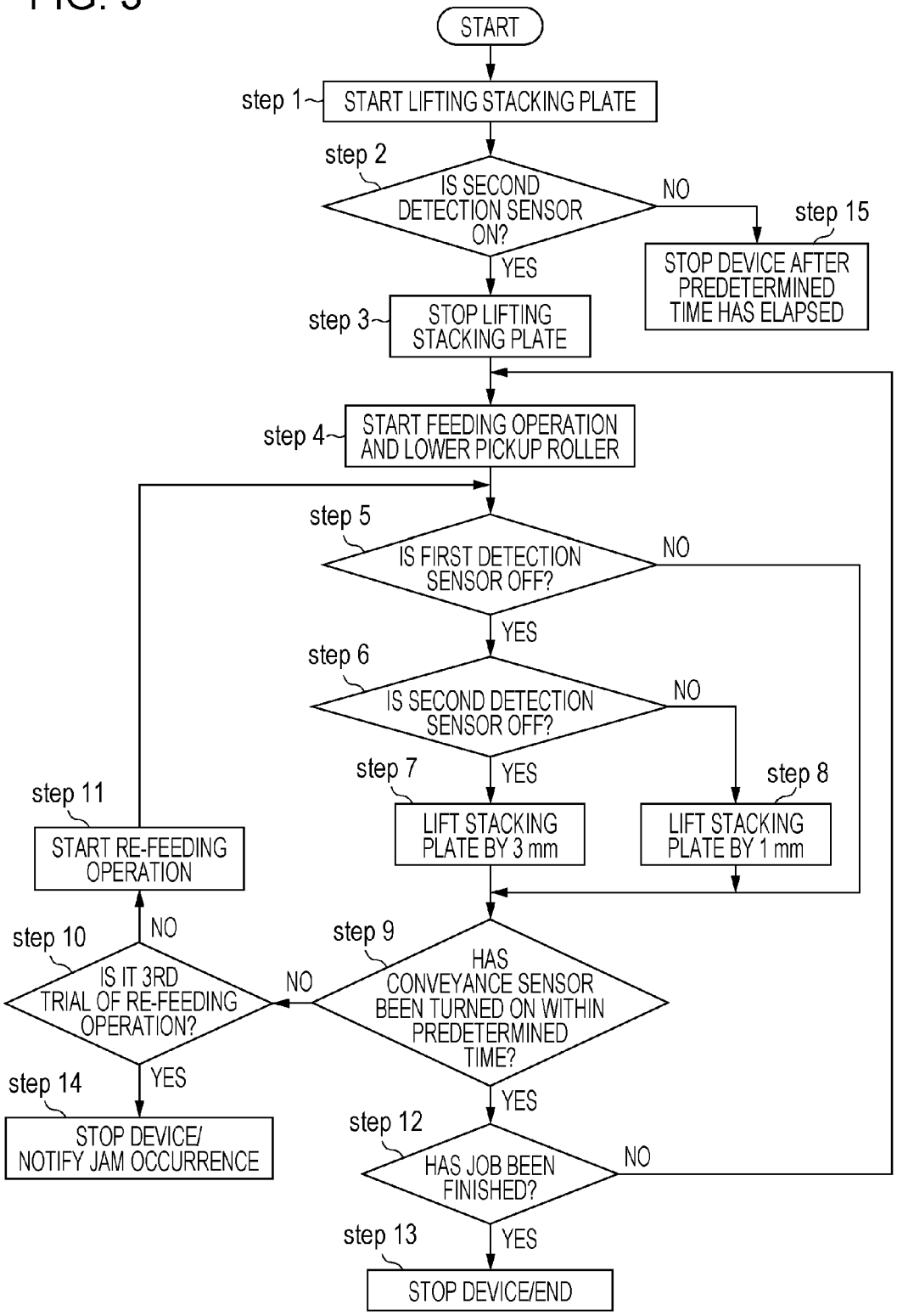
FIG. 3 is a flowchart illustrating an operation according to the first embodiment.

FIG. 3 is a flowchart illustrating an operation according to the first embodiment. In the first embodiment, the amount by which the stacking plate 206 is lifted in a normal case (a first predetermined amount) is set to 1 mm, and the amount by which the stacking plate 206 is lifted in a case where the stack of sheets 8 is curled (a second predetermined amount) is set to 3 mm. In the first embodiment, the allowable number of trials of a re-feeding operation is two.

Figure 6A:
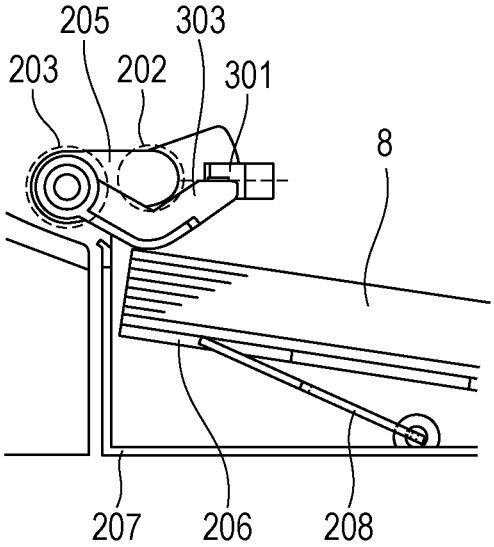
FIGS. 6A and 6B illustrate the sheet feeding device according to the first embodiment.
Figure 6B:
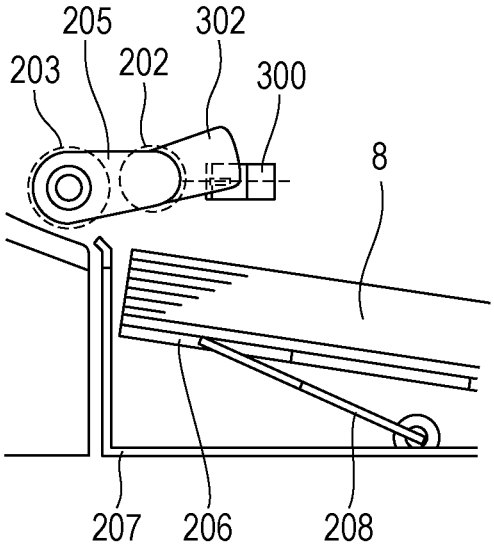

When the sheet cassette 201 containing sheets 8 is inserted into the image forming apparatus 101, the attaching detecting unit 70 outputs an on signal. On the basis of the signal from the attaching detecting unit 70, the control unit activates the motor 227, thereby lifting the stacking plate 206 (step 1). Since the stacking plate 206 is lifted, the upper surface of the stack of sheets 8 on the stacking plate 206 pushes up the second-sensor-detected member 303, whereby the second detection sensor 301 is turned on (a state illustrated in FIGS. 6A and 6B and corresponding to step 2). In this step, since the pickup roller 202 is at the upper position, the first detection sensor 300 is on. Hence, the control unit lifts the stacking plate 206 up to a position higher by a third predetermined amount than the position where the stack of sheets 8 is detected by the second detecting unit. Thus, the stack of sheets 8 on the stacking plate 206 is lifted to the feedable position.

If the second detection sensor 301 is not turned on after a first predetermined time from when the motor 227 has started to lift the stacking plate 206, the control unit stops the sheet feeding device and notifies the occurrence of a failure (step 15). The term "failure" used herein refers to a possibility of either a failure of the lifting unit or a failure of the second detecting unit.

When a second predetermined time has elapsed after the second detection sensor 301 has been turned on, the control unit stops the application of the voltage to the solenoid 219 and stops lifting the stacking plate 206 (step 3). Thus, the stack of sheets 8 on the stacking plate 206 is set to the feedable position.

Subsequently, the control unit applies a voltage to the solenoid 270, thereby lowering the pickup roller 202 and bringing the pickup roller 202 into contact with the upper surface of the stack of sheets 8 so that the feeding operation is started (step 4). When the pickup roller 202 rotates, one of the sheets 8 is picked up.

After lowering the pickup roller 202, the control unit checks whether or not the signal of the first detection sensor 300 is off (step 5). Furthermore, the control unit checks whether or not the signal of the second detection sensor 301 is off (step 6). More specifically, the control unit checks the outputs of the signals generated by the first detection sensor 300 and the second detection sensor 301 with the pickup roller 202 having been lowered.

In steps 5 and 6, if the first detection sensor 300 and the second detection sensor 301 are both on, the stack of sheets 8 is regarded as being at the feedable position. Therefore, one of the sheets 8 is expected to be picked up normally. The sheet 8 thus picked up is conveyed to the nip portion between the feed roller 203 and the retard roller 204 and is further conveyed to the nip portion between the conveying roller 250 and the counterpart conveying roller 252 by the feed roller 203.

When a conveyance-sensor-detected member 254 is rotated by the sheet 8, a conveyance sensor 255 is turned on. If the conveyance sensor 255 is turned on within a third predetermined time after the start of the feeding operation (step 9) and if the job has not been finished (step 12), the next feeding operation is started after a fourth predetermined time has elapsed (the process returns to step 4). The conveyance-sensor-detected member 254 and the conveyance sensor 255 constitute a conveyance detecting unit. The conveyance detecting unit detects that the sheet 8 has reached a position immediately on the downstream side of the nip portion formed between the pair of registration rollers.

As the number of sheets 8 that have been fed increases and the level of the upper surface of the stack of sheets 8 becomes lower, the first detection sensor 300 is eventually turned off in step 5. If the first detection sensor 300 is off in step 5 but the second detection sensor 301 is on in step 6, the control unit lifts the stacking plate 206 by 1 mm (step 8).

Figure 8A:
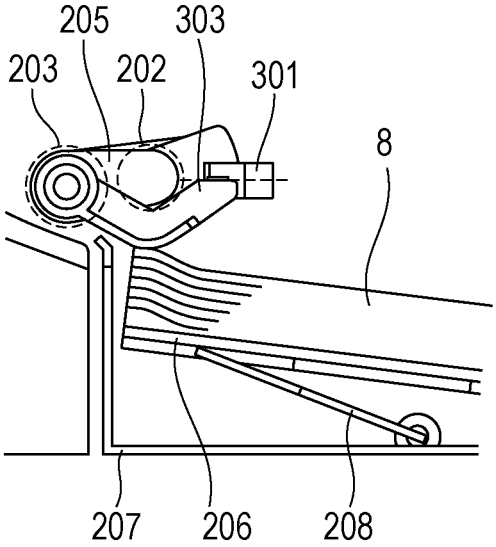
FIGS. 8A and 8B illustrate the sheet feeding device according to the first embodiment.
Figure 8B:
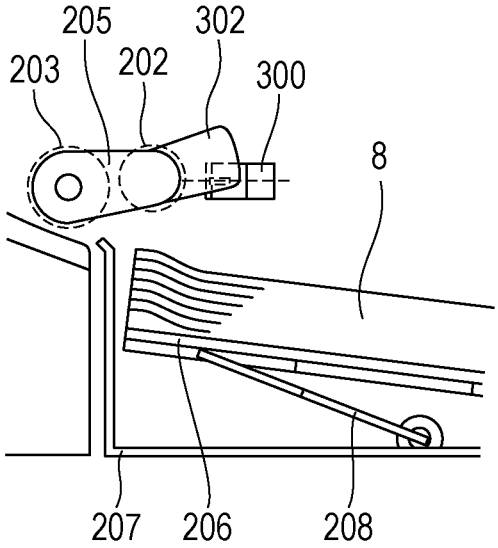
Figure 9A:
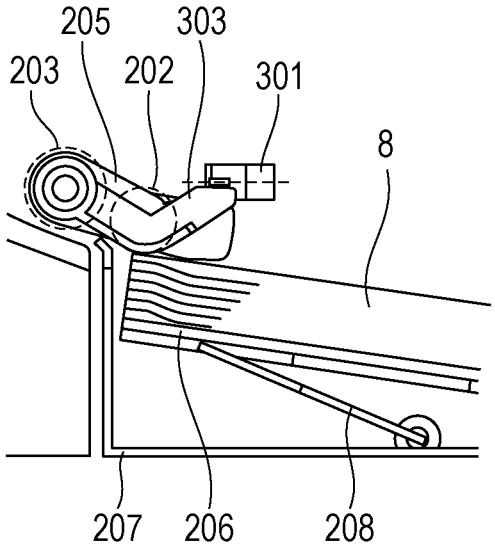
FIGS. 9A and 9B illustrate the sheet feeding device according to the first embodiment.
Figure 9B:
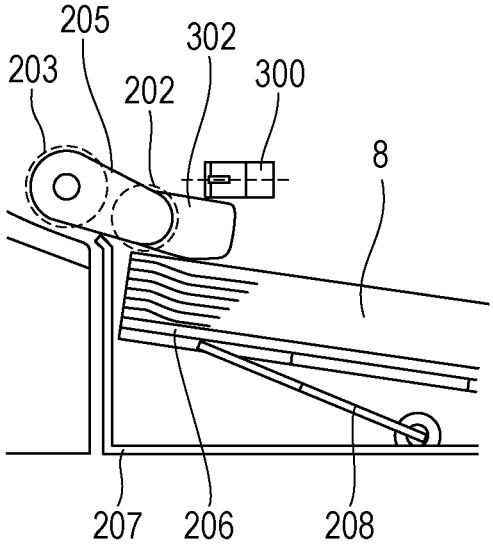

In some cases, as illustrated in FIGS. 8A and 8B, a downstream portion of the stack of sheets 8 in the direction of sheet feeding may be curled upward. In such a state, if the pickup roller 202 is lowered as illustrated in FIGS. 9A and 9B, the stack of sheets 8 is pushed down by an extra amount corresponding to the size of the curl. Consequently, the pickup roller 202 cannot apply, to the stack of sheets 8, a pressing force that is necessary for feeding, resulting in a possible failure in feeding a sheet 8 (such a failure is hereinafter referred to as "no pick").

In such a state, since the stack of sheets 8 is pushed down, the first detection sensor 300 and the second detection sensor 301 are turned off in step 5 and in step 6, respectively. In this case, the control unit lifts the stacking plate 206 by 3 mm (step 7).

Furthermore, since no pick has occurred in the above state, no sheet 8 reaches the conveyance sensor 255 within the third predetermined time (step 9). In such a case, if the number of trials of the re-feeding operation has not reach three (step 10), the control unit starts the re-feeding operation (step 11).

Figure 7A:
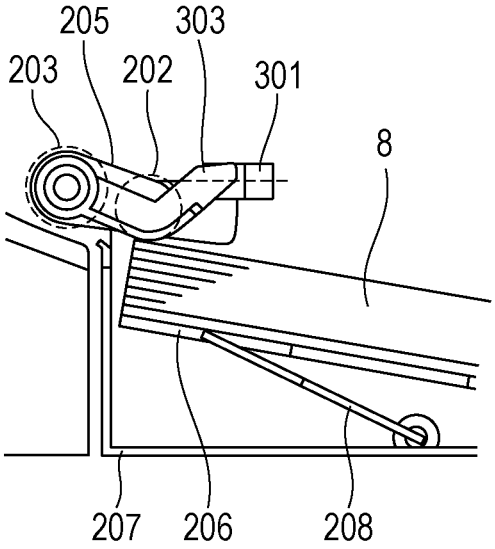
FIGS. 7A and 7B illustrate the sheet feeding device according to the first embodiment.
Figure 7B:
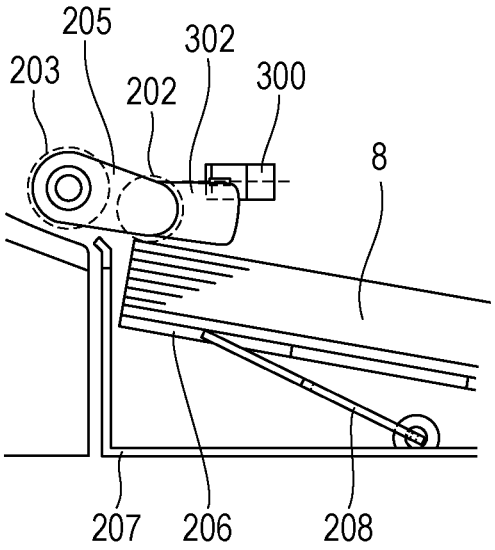

If the size of the curl in the stack of sheets 8 is about 3 mm, it is regarded that the level of the upper surface of the stack of sheets 8 on the stacking plate 206 is higher than that in the normal case by 3 mm. Therefore, as illustrated in FIGS. 7A and 7B, a pressing force is applied to the stack of sheets 8 by the pickup roller 202 in the next trial of the feeding operation (a first re-feeding operation). Hence, one of the sheets 8 is conveyed.

In the first embodiment, two trials of the re-feeding operation are allowed at the maximum. Therefore, even if the stack of sheets 8 has a curl of about 6 mm, such sheets 8 are feedable without the occurrence of a jam. If no sheet 8 is fed after two trials of the re-feeding operation (step 10), the control unit stops the sheet feeding device and notifies the failure as a jam (step 14).

There may be a rare case where a sheet 8 is fed despite the second detection sensor 301 being off in step 6 (with no trial of the re-feeding operation). In such a case, the sheet 8 is stopped by the pair of registration rollers.

The first embodiment concerns a case where the stacking plate 206 is lifted by 1 mm in step 8 and by 3 mm in step 7. Alternatively, the position of detection by the second-sensor-detected member 303 may be lowered, and the amount of lifting in step 7 may be increased instead. Moreover, the number of trials of the re-feeding operation is to be determined on the basis of restrictions and conditions specified for the sheet feeding device.

While the first embodiment concerns a case where the user inserts a sheet 8 into the manual feeding slot 312, this embodiment is not seen to be limiting. In another embodiment, the configuration can include a rotatable manual-feed stacking member and a pickup roller that picks up one of sheets on the manual-feed stacking member.

Second Embodiment

A sheet feeding device according to a second embodiment will now be described. In the first embodiment, the amount of lifting of the stacking plate 206 is determined on the basis of the results of detection by the first detecting unit and the second detecting unit.

In the second embodiment, another detecting unit, i.e., a third detecting unit, is provided. According to the second embodiment, the control unit determines the amount of lifting of the stacking plate 206 on the basis of the results of detection by the three detecting units. Therefore, the detection accuracy is improved in a case where the stack of sheets 8 is curled in a direction orthogonal to the direction of sheet conveyance. In the second embodiment, description of elements and operations that are common to those described in the first embodiment is omitted.

Figure 11:
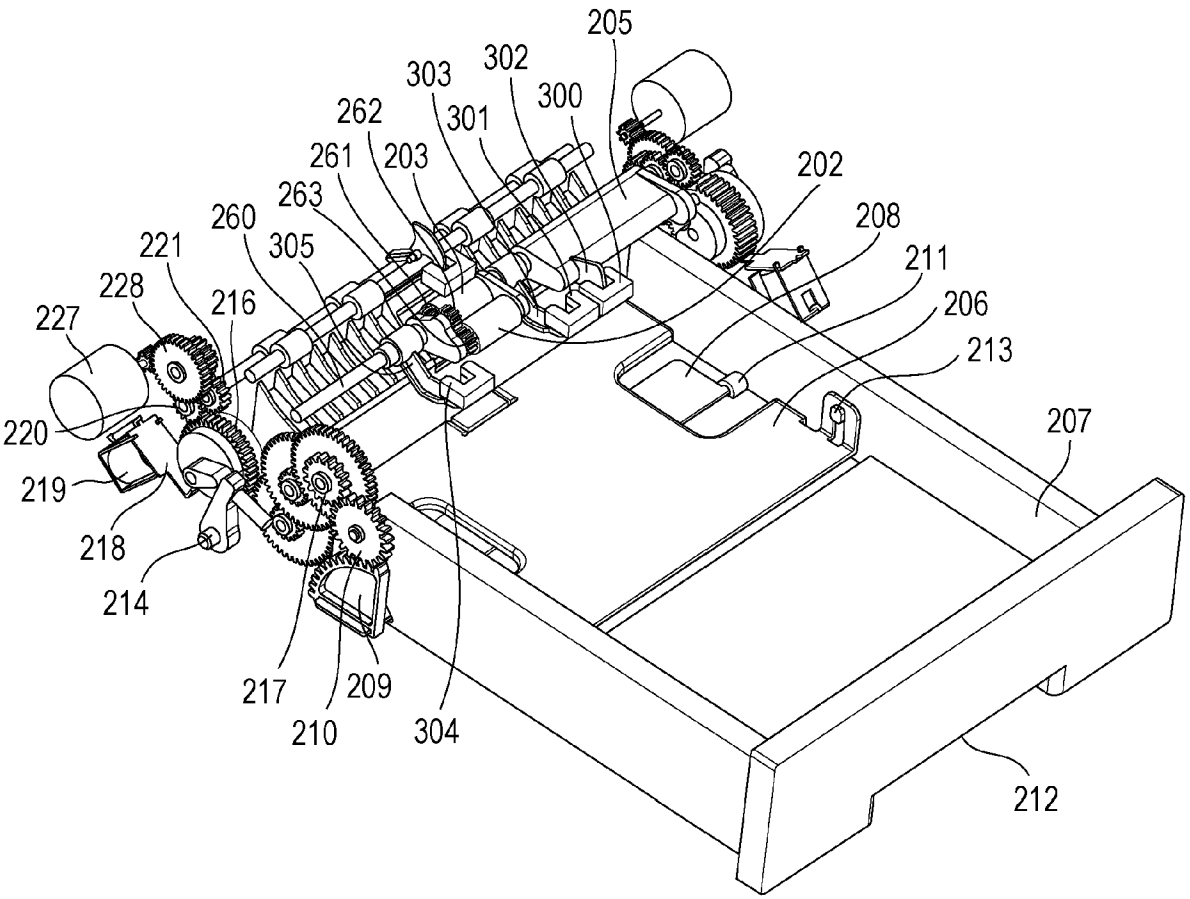
FIG. 11 is a perspective view of a sheet feeding device according to a second embodiment.
Figure 12:
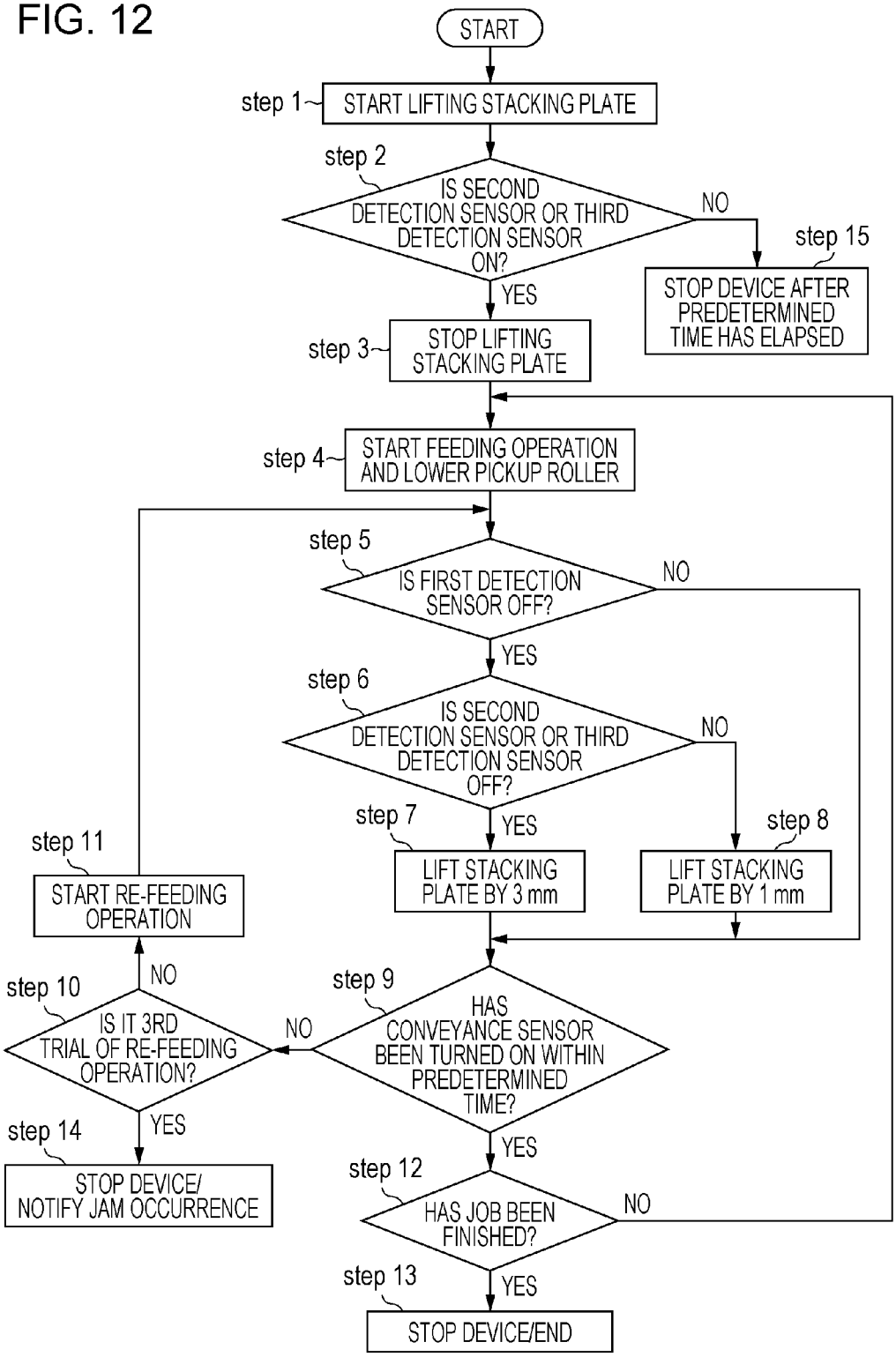
FIG. 12 is a flowchart illustrating an operation according to the second embodiment.

FIG. 11 is a perspective view of the sheet feeding device according to the second embodiment. In the second embodiment, a third detection sensor 304 and a third-sensor-detected member 305 are provided on a lateral side of the pickup roller 202. The shape and the center of rotation of the third-sensor-detected member 305 are the same as those of the second-sensor-detected member 303. The position where the third detection sensor 304 is turned on is the same as the position where the second detection sensor 301 is turned on. That is, the third-sensor-detected member 305 is provided in such a manner as to be rotatable about the shaft 260 of the feed roller 203 and switches the signal of the third detection sensor 304, which is a photosensor, between on (a state where light is blocked) and off (a state where light is allowed to travel).

FIG. 11 is a flowchart illustrating an operation according to the second embodiment.

The flowchart according to the second embodiment is the same as the flowchart according to the first embodiment, except steps 2 and 6. Hence, description of steps that are the same as those of the first embodiment is omitted according to need. If the stack of sheets 8 is curled in the width direction, the second detection sensor 301 and the third detection sensor 304 are turned on at different timings during the lifting of the stacking plate 206. The following description concerns a case where the size of the curl in the stack of sheets 8 is larger on the side corresponding to the second-sensor-detected member 303 than on the side corresponding to the third-sensor-detected member 305.

Figure 13A:
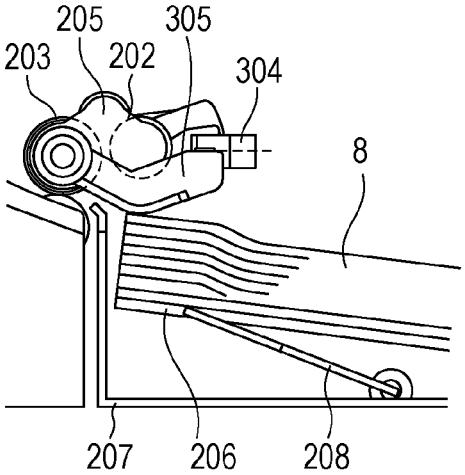
FIGS. 13A to 13C illustrate the sheet feeding device according to the second embodiment.
Figure 13B:
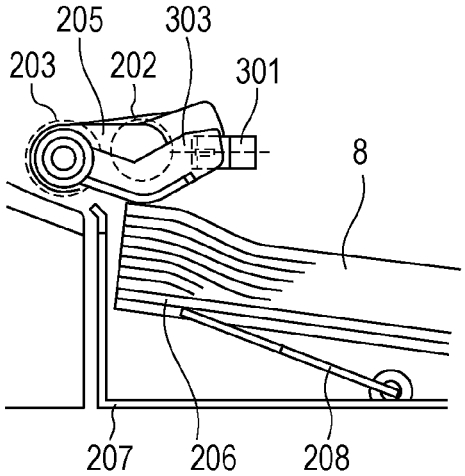
Figure 13C:
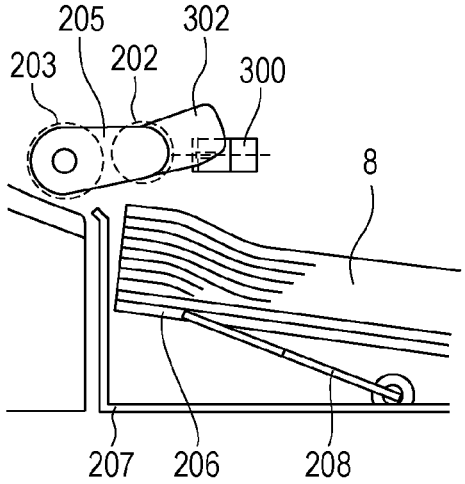

After the stacking plate 206 starts to be lifted in step 1, the upper surface of the stack of sheets 8 first pushes up the second-sensor-detected member 303 and then pushes up the third-sensor-detected member 305. That is, as illustrated in FIGS. 13A to 13C, after the second detection sensor 301 is turned on, the third detection sensor 304 is turned on (step 2).

Figure 14A:
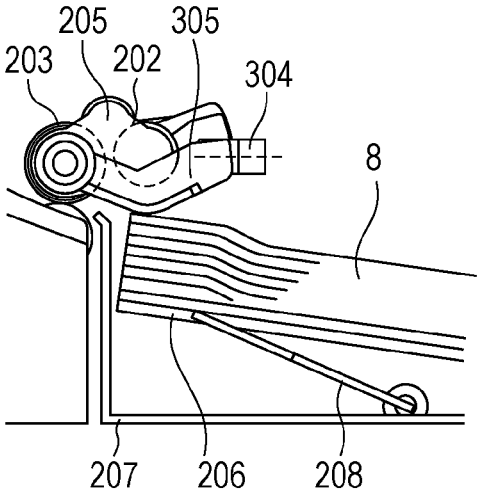
FIGS. 14A to 14C illustrate the sheet feeding device according to the second embodiment.
Figure 14B:
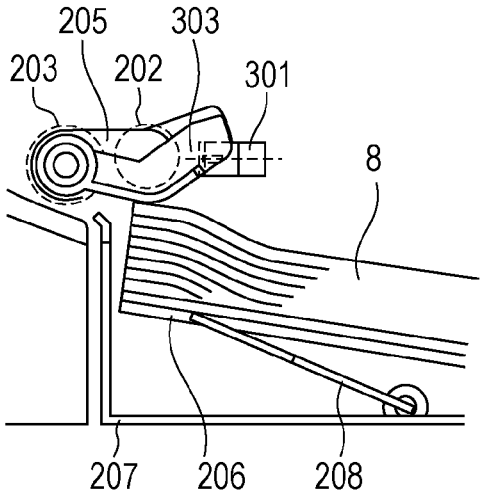
Figure 14C:
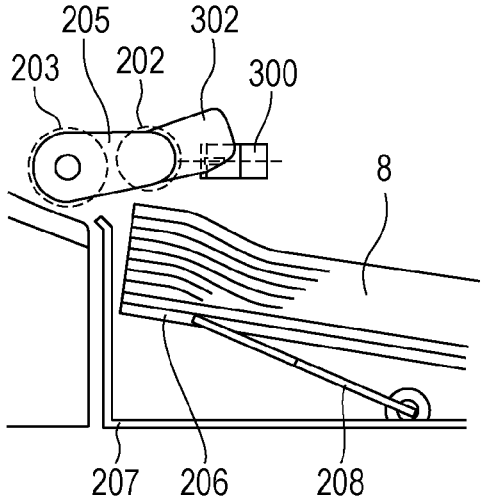

As illustrated in FIGS. 14A to 14C, when the second predetermined time has elapsed after the third detection sensor 304 has been turned on, the control unit stops the application of the voltage to the solenoid 219, thereby stopping the lifting of the stacking plate 206 (step 3).

Figure 15A:
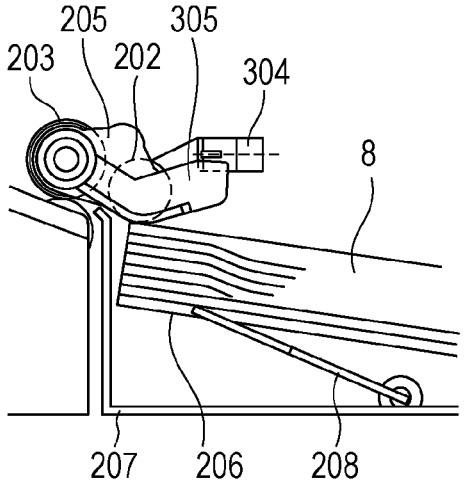
FIGS. 15A to 15C illustrate the sheet feeding device according to the second embodiment.
Figure 15B:
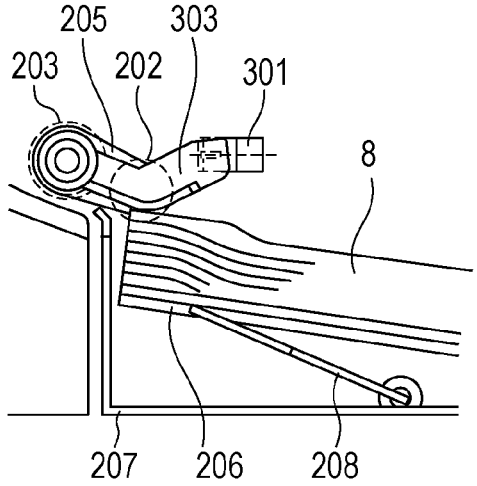
Figure 15C:
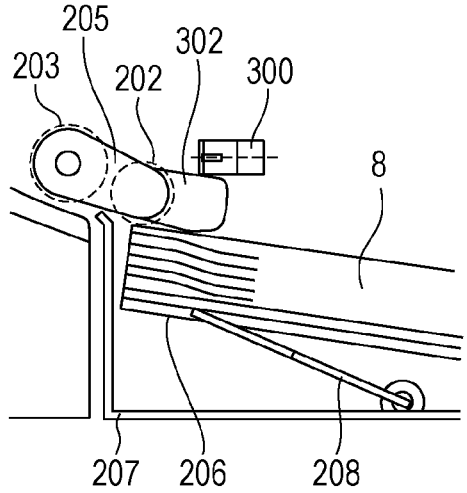

As illustrated in FIGS. 15A to 15C, if the stack of sheets 8 is curled, the pickup roller 202 cannot apply, to the stack of sheets 8, a pressing force that is necessary for feeding, resulting in a possible failure in feeding a sheet 8. In the second embodiment, if either of the second detection sensor 301 and the third detection sensor 304 is turned off in step 6, the stacking plate 206 is lifted by 3 mm (step 7).

Thus, in the second embodiment, even if the stack of sheets 8 is curled in the width direction, the probability that a sheet 8 can be fed by performing the re-feeding operation is increased. In the above exemplary case, even if the size of the curl in the stack of sheets 8 is about 3 mm at a position corresponding to the third-sensor-detected member 305 and about 6 mm at a position corresponding to the second-sensor-detected member 303, a pressing force that is necessary for feeding can be applied to the stack of sheets 8 as illustrated in FIGS. 7A and 7B in a single trial of the re-feeding operation.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2013-251321, filed Dec. 4, 2013, which is hereby incorporated by reference herein in its entirety.

What is claimed is:

1. A sheet feeding device comprising:

a stacking member on which a sheet is placed;

a lifting unit configured to lift the stacking member;

a pickup member that is movable between a pickup position where the pickup member picks up the sheet placed on the stacking member and a retreat position where the pickup member does not contact with the sheet placed on the stacking member, wherein the pickup member, being in the pickup position, contacts with the sheet;

a pickup-member-moving unit configured to move the pickup member between the pickup position and the retreat position;

a first detecting unit configured to detect the pickup member being in the pickup position, wherein an upper surface of the sheet with which the pickup member, being in the pickup position, contacts is in a first position;

a second detecting unit configured to detect the upper surface of the sheet in a second position which is lower than the first position in a vertical direction; and a control unit configured to control the lifting unit based on a detection result of the first detecting unit and the second detecting unit, wherein the control unit controls the lifting unit to lift the stacking member, and then the pickup-member-moving unit moves the pickup member from the retreat position to the pickup position after the second detecting unit detects the upper surface of the sheet, wherein, in a case where the first detecting unit does not detect the pickup member and the second detecting unit detects the upper surface of the sheet, the control unit controls the lifting unit to lift the stacking member by a first predetermined amount, and wherein, in a case where the first detecting unit does not detect the pickup member and the second detecting unit does not detect the upper surface of the sheet, the control unit controls the lifting unit to lift the stacking member by a second predetermined amount that is greater than the first predetermined amount.

2. The sheet feeding device according to claim 1, wherein, in a case where the first detecting unit detects the pickup member and the second detecting unit detects the upper surface of the sheet, the control unit controls the lifting unit not to lift the stacking member.

3. The sheet feeding device according to claim 1, wherein, for every feeding of one sheet, the pickup-member-moving unit moves the pickup member from the retreat position to the pickup position, and moves the pickup member from the pickup position to the retreat position.

4. The sheet feeding device according to claim 1, wherein the pickup member includes a pickup roller configured to pick up the sheet placed on the stacking member, and a supporting portion configured to support the pickup roller, and wherein the pickup-member-moving unit moves the pickup roller between the pickup position and the retreat position by rotating the supporting portion.

5. The sheet feeding device according to claim 4, wherein the first detecting unit includes a first detected member configured to operate in conjunction with the supporting portion, and a first sensor configured to detect the first detected member, and wherein the second detecting unit includes a second detected member configured to come into contact with the sheet placed on the stacking member, and a second sensor configured to detect the second detected member.

6. The sheet feeding device according to claim 1, further comprising:

a feeding member provided on a downstream side of the pickup member and configured to feed the sheet that has been picked up by the pickup member; and another stacking member on which a sheet is placed, wherein a first conveyance path along which the sheet placed on the stacking member is conveyed, and a second conveyance path along which the sheet placed on the another stacking member is conveyed, merge with each other at a position on an upstream side of the feeding member.

7. The sheet feeding device according to claim 6, wherein the sheet fed from the another stacking member passes a position below the pickup member that is at the retreat position.

8. The sheet feeding device according to claim 1, wherein the stacking member is included in a sheet containing unit that is provided in such a manner as to be attachable to and detachable from a main body, wherein the sheet feeding device includes an attaching detecting unit configured to detect attachment of the sheet containing unit to the main body, and wherein, in a case where the attaching detecting unit has detected the attachment of the sheet containing unit to the main body, the control unit controls the lifting unit to lift the stacking member by a third predetermined amount after the second detecting unit detects the upper surface of the sheet.

9. The sheet feeding device according to claim 1, wherein the lifting unit includes a first drive source configured to generate a driving force, and a first solenoid configured to be switched based on whether to transmit the driving force from the first drive source to the stacking member, and wherein the pickup-member-moving unit includes a second drive source configured to generate a driving force, and a second solenoid configured to be switched based on whether to transmit the driving force from the second drive source to the pickup member.

10. The sheet feeding device according to claim 1, further comprising:

a third detecting unit configured to detect the upper surface of the sheet placed on the stacking member at the same position of detection by the second detecting unit in the vertical direction, wherein the third detecting unit detects the upper surface of the sheet placed on the stacking member at a position different from the position of detection by the second detecting unit in a direction orthogonal to a direction of sheet conveyance, wherein, in a case where the first detecting unit does not detect the pickup member and both of the second detecting unit and the third detecting unit detect the upper surface of the stack of sheets, the control unit controls the lifting unit to lift the stacking member by the first predetermined amount, and wherein, in a case where the first detecting unit does not detect the pickup member and at least either one of the second detecting unit and the third detecting unit does not detect the upper surface of the stack of sheets, the control unit controls the lifting unit to lift the stacking member by the second predetermined amount.

11. The sheet feeding device according to claim 1, wherein, in a case where the control unit controls the lifting unit to lift the stacking member for a predetermined time, during which the second detecting unit does not detect the upper surface of the sheet, the control unit controls the lifting unit not to lift the stacking member.

12. An image forming apparatus that forms an image on a sheet, the image forming apparatus comprising:

a stacking member on which a sheet is placed;

a lifting unit configured to lift the stacking member;

a pickup member that is movable between a pickup position where the pickup member picks up the sheet placed on the stacking member and a retreat position where the pickup member does not contact with the sheet placed on the stacking member, wherein the pickup member, being in the pickup position, contacts with the sheet;

an image forming portion configured to form an image on the sheet that has been picked up by the pickup member;

a pickup-member-moving unit configured to move the pickup member between the pickup position and the retreat position;

a first detecting unit configured to detect the pickup member being in the pickup position, wherein an upper surface of the sheet with which the pickup member, being in the pickup position, contacts is in a first position;

a second detecting unit configured to detect the upper surface of the sheet in a second position which is lower than the first position in a vertical direction; and a control unit configured to control the lifting unit based on a detection result of the first detecting unit and the second detecting unit, wherein the control unit controls the lifting unit to lift the stacking member, and then the pickup-member-moving unit moves the pickup member from the retreat position to the pickup position after the second detecting unit detects the upper surface of the sheet, wherein, in a case where the first detecting unit does not detect the pickup member and the second detecting unit detects the upper surface of the sheet, the control unit controls the lifting unit to lift the stacking member by a first predetermined amount, and wherein, in a case where the first detecting unit does not detect the pickup member and the second detecting unit does not detect the upper surface of the sheet, the control unit controls the lifting unit to lift the stacking member by a second predetermined amount that is greater than the first predetermined amount.

13. The image forming apparatus according to claim 12, wherein, in a case where the first detecting unit detects the pickup member and the second detecting unit detects the upper surface of the sheet, the control unit controls the lifting unit not to lift the stacking member.

14. The image forming apparatus according to claim 12, wherein, for every feeding of one sheet, the pickup-member-moving unit moves the pickup member from the retreat position to the pickup position, and moves the pickup member from the pickup position to the retreat position.

15. The image forming apparatus according to claim 12, wherein the pickup member includes a pickup roller configured to pick up the sheet placed on the stacking member, and a supporting portion configured to support the pickup roller, and wherein the pickup-member-moving unit moves the pickup roller between the pickup position and the retreat position by rotating the supporting portion.

16. The image forming apparatus according to claim 15, wherein the first detecting unit includes a first detected member configured to operate in conjunction with the supporting portion, and a first sensor configured to detect the first detected member, and wherein the second detecting unit includes a second detected member configured to come into contact with the sheet placed on the stacking member, and a second sensor configured to detect the second detected member.

17. The image forming apparatus according to claim 12, further comprising:

a feeding member provided on a downstream side of the pickup member and configured to feed the sheet that has been picked up by the pickup member; and another stacking member on which a sheet is placed, wherein a first conveyance path along which the sheet placed on the stacking member is conveyed, and a second conveyance path along which the sheet placed on the another stacking member is conveyed, merge with each other at a position on an upstream side of the feeding member.

18. The image forming apparatus according to claim 17, wherein the sheet fed from the another stacking member passes a position below the pickup member that is at the retreat position.

19. The image forming apparatus according to claim 12, wherein the stacking member is included in a sheet containing unit that is provided in such a manner as to be attachable to and detachable from a main body, wherein the sheet feeding device includes an attaching detecting unit configured to detect attachment of the sheet containing unit to the main body, and wherein, in a case where the attaching detecting unit has detected the attachment of the sheet containing unit to the main body, the control unit controls the lifting unit to lift the stacking member by a third predetermined amount after the second detecting unit detects the upper surface of the sheet.

20. The image forming apparatus according to claim 12, wherein the lifting unit includes a first drive source configured to generate a driving force, and a first solenoid configured to be switched based on whether to transmit the driving force from the first drive source to the stacking member, and wherein the pickup-member-moving unit includes a second drive source configured to generate a driving force, and a second solenoid configured to be switched based on whether to transmit the driving force from the second drive source to the pickup member.

21. The image forming apparatus according to claim 12, further comprising:

a third detecting unit configured to detect the upper surface of the sheet placed on the stacking member at the same position of detection by the second detecting unit in the vertical direction, wherein the third detecting unit detects the upper surface of the sheet placed on the stacking member at a position different from the position of detection by the second detecting unit in a direction orthogonal to a direction of sheet conveyance, wherein, in a case where the first detecting unit does not detect the pickup member and both of the second detecting unit and the third detecting unit detect the upper surface of the stack of sheets, the control unit controls the lifting unit to lift the stacking member by the first predetermined amount, and wherein, in a case where the first detecting unit does not detect the pickup member and at least either one of the second detecting unit and the third detecting unit does not detect the upper surface of the stack of sheets, the control unit controls the lifting unit to lift the stacking member by the second predetermined amount.

22. The image forming apparatus according to claim 12, wherein, in a case where the control unit controls the lifting unit to lift the stacking member for a predetermined time, during which the second detecting unit does not detect the upper surface of the sheet, the control unit controls the lifting unit not to lift the stacking member.

23. A sheet feeding device, comprising:

a stacking member on which a sheet is placed;

a lifting unit configured to lift the stacking member;

a pickup member that is movable between a pickup position where the pickup member picks up the sheet placed on the stacking member and a retreat position where the pickup member does not contact with the sheet placed on the stacking member, wherein the pickup member, being in the pickup position, contacts with the sheet;

a pickup-member-moving unit configured to move the pickup member between the pickup position and the retreat position;

a first detecting unit configured to detect the pickup member being in the pickup position, wherein an upper surface of the sheet with which the pickup member, being in the pickup position, contacts is in a first position; and a second detecting unit configured to detect the upper surface of the sheet in a second position which is lower than the first position in a vertical direction, wherein the lifting unit is controlled by a control unit based on a detection result of the first detecting unit and the second detecting unit, wherein the lifting unit is controlled by the control unit in such a manner as to lift the stacking member, and then the pickup-member-moving unit moves the pickup member from the retreat position to the pickup position after the second detecting unit detects the upper surface of the sheet, wherein, in a case where the first detecting unit does not detect the pickup member and the second detecting unit detects the upper surface of the sheet, the lifting unit is controlled by the control unit in such a manner as to lift the stacking member by a first predetermined amount, and wherein, in a case where the first detecting unit does not detect the pickup member and the second detecting unit does not detect the upper surface of the sheet, the lifting unit is controlled by the control unit in such a manner as to lift the stacking member by a second predetermined amount that is greater than the first predetermined amount.

* * * * *